US005704521A

United States Patent [19]

Grogan et al.

[11] Patent Number: 5,704,521

[45] Date of Patent: Jan. 6, 1998

[54] TRIGGER ACTUATED SPRAYER

[75] Inventors: R. Pat Grogan, Downey; Ronald Wadsworth, Cambria, both of Calif.

[73] Assignee: Calmar Inc., City of Industry, Calif.

[21] Appl. No.: 469,525

[22] Filed: Jun. 6, 1995

[51] Int. Cl.[6] ..... B67D 5/40

[52] U.S. Cl. ..... 222/383.1; 222/153.06

[58] Field of Search ..... 222/182, 383.1, 222/382, 541.6, 541.9, 153.05–153.07; 215/254, 255; 239/333

[56] References Cited

U.S. PATENT DOCUMENTS

| | | | |
|---|---|---|---|
| 4,257,539 | 3/1981 | Cary et al. | 222/383.1 |
| 4,356,935 | 11/1982 | Kamin | 222/153.06 |
| 4,434,917 | 3/1984 | Saito et al. | 222/383.1 |
| 5,335,858 | 8/1994 | Dunning et al. | 239/333 |
| 5,356,049 | 10/1994 | Harris et al. | 222/383.1 |

FOREIGN PATENT DOCUMENTS

| | | | |
|---|---|---|---|
| 254505 | 1/1988 | European Pat. Off. | 222/383.1 |

*Primary Examiner*—Philippe Derakshani

*Attorney, Agent, or Firm*—Watson Cole Stevens Davis, P.L.L.C.

[57] ABSTRACT

A low cost trigger sprayer comprises a pump body, a hand support flange extending laterally from the body for engaging an operator's hand when operating the sprayer, and a container closure cap on the body, the pump body comprising a pump cylinder, an upstanding dip tube support sleeve, and a laterally extending tubular outlet, the pump cylinder, support sleeve, tubular outlet, closure cap and hand support flange being of a one-piece molded plastic construction, and a separate cover overlying at least top and rearward ends of the pump body and extending to the hand support flange.

16 Claims, 2 Drawing Sheets

TRIGGER ACTUATED SPRAYER

BACKGROUND OF THE INVENTION

This invention relates generally to trigger actuated sprayers, and more particularly to low cost trigger sprayers which are easy to mold and assemble and have a minimum number of parts for satisfying the reduced cost needs of the customer while at the same time offering a unique and easy to handle trigger sprayer.

Known trigger sprayers have a number of plastic molded parts normally preassembled then assembled together to form the unit. For example, a separate container closure of the threaded or snap on type is fitted to the lower end of the pump body for relative rotation for mounting the pump to a container of liquid to be sprayed. And, the shroud cover, typically fitted about the pump body, is a molded plastic part having an integral or attachable hand positioner at its rearward end for engaging the dorsal web of the hand of the operator between the thumb and the index finger when gripped about the container to operate the trigger. Such a hand positioner assists in supporting the container, which may be large and heavy, to which the trigger sprayer is mounted, while operating the sprayer.

Because the weight of the container is largely supported by the hand positioner, the shroud having an integrally formed hand positioner must be securely attached to the pump body at several snap-on or the like locations which typically utilizes heavy snap connectors to withstand the load placed on the shroud. This only adds to the cost of molding the shroud.

Also, should a hand positioner be snapped onto the rearward end of a conventional trigger sprayer shroud, the connectors must be sufficiently heavy duty to support the weight of the container during trigger sprayer use.

SUMMARY OF THE INVENTION

It is therefore an object of the present invention to improve upon known trigger sprayer constructions by reducing the number of parts while at the same time maintaining the hand support but allowing for a less expensive and less sturdy shroud or cover structure which voids the need for a durable snap connector or the like, thereby reducing the cost of molding and saving labor costs by reducing assembly time.

The trigger sprayer according to the invention includes a pump body having a container closure and a hand positioner of one-piece plastic molded construction, thereby saving at least one part and providing for a thinner and less durable molded shroud or other type inexpensive cover permitting a more conventional attachment to the pump body as the shroud or cover itself does not function to support the weight of the container and its contents as before.

In one embodiment, the shroud has top, opposed side and rearward walls for enclosing the pump body, the rearward wall being spaced either inwardly of the outer edge of the hand positioner or extending to that edge.

In another embodiment, outer opposed walls located at opposite sides of the pump body are integrally molded with the pump body, hand support and closure cap, thereby presenting an exposed upper and rearward end of the pump body which are closed by the cover which may be in the form of an adhesive backed strip of tape.

The strip of tape may be removably attached to a nozzle cap on the trigger to render the same tamper evident and may further overlie the discharge orifice to render the same leakproof during shipping and storage. Moreover, the integral container closure may be out-of-round for fitting with the neck finish of the bottle of similar shape for orienting the trigger sprayer in place.

Other objects, advantages and novel features of the invention will become more apparent from the following detailed description of the invention when taken in conjunction with the accompanying drawings.

DETAILED DESCRIPTION OF THE INVENTION

Figures 1, 2, 3, 4, 5, 6, 7, 8:
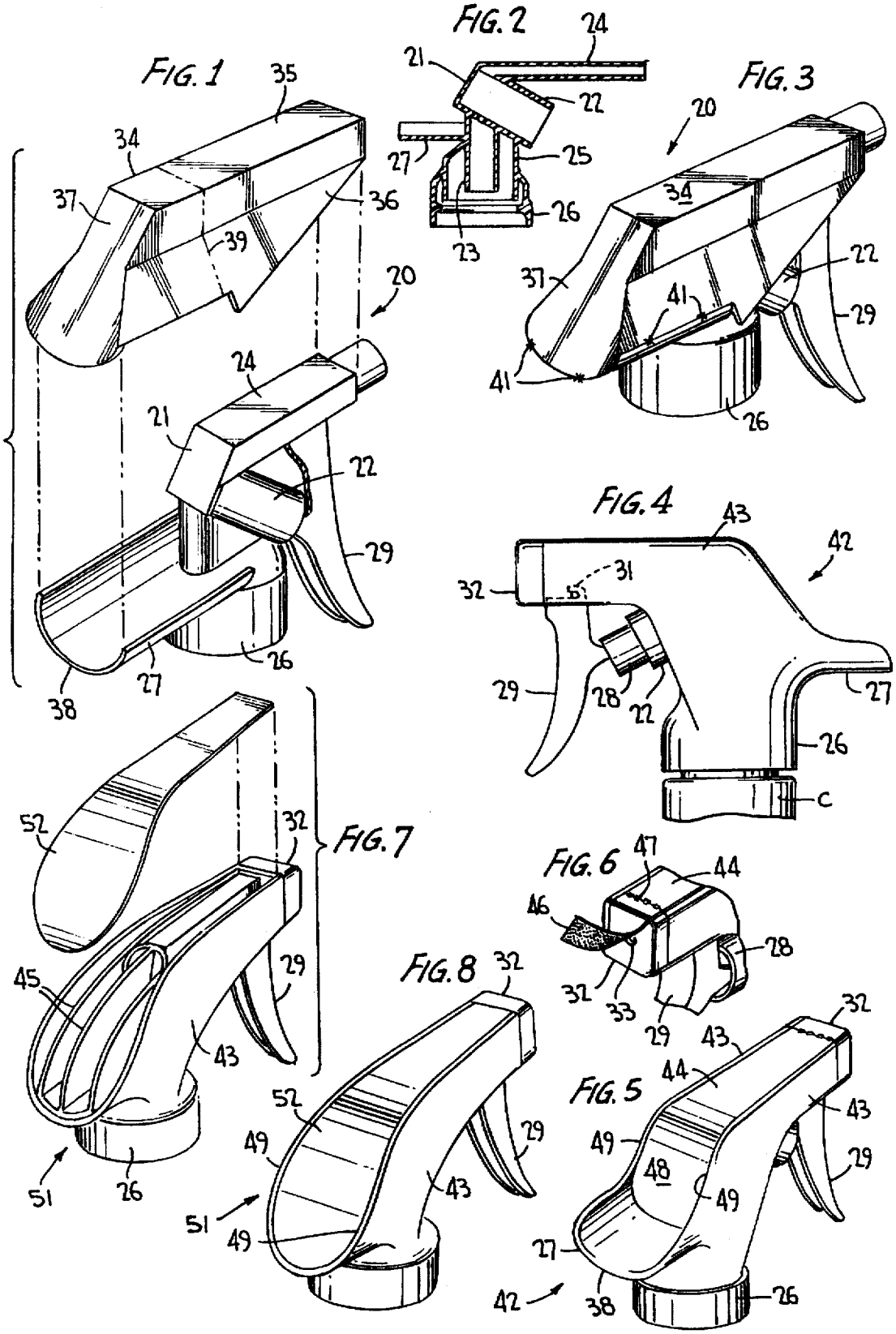
FIG. 1 is a perspective view of the trigger sprayer according to one embodiment of the invention in exploded view prior to attachment of the shroud cover.
FIG. 2 is a vertical sectional view of the pump body, container closure and hand support of one-piece molded plastic construction shown in FIG. 1.
FIG. 3 is a view similar to FIG. 1 of the trigger sprayer showing the shroud cover attached in place.
FIG. 4 is a side elevational view of a trigger sprayer according to another embodiment of the invention.
FIG. 5 is a perspective view of the FIG. 4 trigger sprayer.
FIG. 6 is a perspective view showing a part of the FIG. 4 trigger sprayer with tamper evident and shipping seal features.
FIG. 7 is a perspective view of another trigger sprayer according to the invention, in exploded view showing the cover before attachment to the sprayer.
FIG. 8 is a view similar to FIG. 7 showing the cover attached in place.

Turning now to the drawings wherein the like reference characters refer to like and corresponding parts throughout the several views, a trigger sprayer according to one embodiment of the invention is generally designated 20 in FIG. 1 comprising a pump body 21, also shown in FIG. 2, of known construction as having a pump cylinder 22, an upstanding dip tube supporting sleeve 23 and a laterally extending tubular outlet or discharge barrel 24. The pump body further includes an outer sleeve 25. The pump body is typically of a one-piece molded plastic construction. Sleeve 23 supports an inlet valve and dip tube (not shown) as known in the art.

According to the invention, a container closure cap 26 is integrally connected to outer sleeve 25, and a hand support in the form of a flange 27 extends laterally from the pump body in a direction opposite the lateral extension of the outlet tube, and is integrally connected with the pump body.

Thus, the pump body with connected closure cap and hand support shown in FIG. 2 are of a one-piece molded plastic construction.

The closure cap may have an internal rib or ribs or the like to facilitate a snap fit of the pump body to the neck of a container C (FIG. 9), or may be internally threaded to facilitate threaded engagement with the externally threaded neck of the container.

Flange 27 forming the hand support may be upwardly convex as shown, or its undersurface may have a radius of curvature to match that of the top of the operator's hand on which the support rests.

The pump sprayer likewise includes a pump piston 28, more clearly seen in FIG. 4, adapted to reciprocate within the pump cylinder to form therewith a variable volume pump chamber. A trigger lever 29 is hinged to the pump body as at 31 (FIG. 4) and engages the outer end of the piston for piston reciprocation upon actuating the trigger lever in the normal manner against the action of a piston return spring (not shown).

A suitably arranged nozzle cap 32 (FIG. 4) is mounted at the end of the tubular outlet, the nozzle cap having a discharge orifice 33 (FIG. 5) through which liquid is sprayed upon trigger actuation. The nozzle cap may be part of a nozzle assembly of the type disclosed in U.S. Pat. No. 4,706,888, which is adjustable upon nozzle cap rotation between spray-off and stream-off positions. Of course, other known nozzle assemblies may be utilized in carrying out the invention.

At least the top and rearward ends of the pump body and, as shown in FIG. 1, the opposing sides of the pump body, are covered by a separate cover in the form of a shroud 34 having a top wall 35, opposing side walls 36 (only one shown in FIGS. 1 and 3), and an interconnected rear wall 37. As shown in FIG. 3, the shroud surrounds the pump body and overlies hand support 27, such that rear wall 37 extends to outer edge 38 of the hand support. Otherwise, rear wall 37 of the shroud could be located at a position shown in phantom outline in FIG. 1 at 39, such that when the shroud is assembled in place, rear wall 37 is spaced inwardly from outer edge 38 of the hand support, much like that shown in FIG. 5.

Shroud cover 34, typically of molded plastic construction, can be shaped other than shown to conform to the specifications of the customer, and hand support 27 can be accordingly shaped to conform to the selected shape of the shroud. Also, the shroud could be of a special color and contain advertisements or other indicia to fit the customer's needs.

The shroud may be attached in place using a conventional snap fitment with the pump body or flange 27, or can be attached in place as at 41 (FIG. 3) utilizing a hot melt glue or the like.

The trigger sprayer is operated as in any conventional manner, such that, when mounted on a container of liquid to be sprayed, the upper end of the container is gripped by the operator's hand as one or two of the fingers engage the trigger lever. Typically, the hand support rests against the dorsal web of the operator's hand between the thumb and the index finger as the operator grips the container and pulls the trigger. Thus, the weight of the liquid filled container is supported by the hand support on the operator's hand as in the known manner. However, since the hand support is integrally attached to the pump body according to the invention, the support load of the container is not carried by the shroud as in prior art structures or by a separate hand support element attached to the pump body as in some prior art structures. Thus, the attachment means used in securing the shroud in place need not be as durable as in prior art structures, and the shroud itself can be of less expensive molded construction, i.e., thinner and less durable, which accounts for some of the low cost of production of the trigger sprayer.

Another embodiment of the trigger sprayer according to the invention is shown in the remaining drawing Figures of various configurations. For example, trigger sprayer 42 shown in FIGS. 4 to 6 has its pump body, container closure and hand support 26 of the same one-piece molded plastic construction as in FIG. 2, except that the cover is of a different construction. And, trigger sprayer 42 also has opposing outer side walls 43 at opposing sides of the pump body. The outer side walls are of one-piece molded plastic construction together with the pump body, hand support flange 27 and the container closure. This one-piece construction is easy to mold, as the space between the outer side walls is open for pulling the molds during the molding operation. A cover 44, which may be in the form of a strip of adhesive backed plastic material or the like, spans the outer walls and is secured to the pump body and/or supporting ribs therebeneath such as ribs 45 shown in FIG. 7. Otherwise, cover 44 may be adhered to the outer edges of sidewalls 43. The cover strip may have a suitable color unique to the customer or may have an indicia applied such as the name of the customer or the product.

As shown in FIG. 6, the cover strip may be extended as at 46 to overlie nozzle cap 32 providing a tamper evident feature. Also, extension 46 can be made to overlie discharge orifice 33 to provide a shipping seal. Extension 46 can project beyond an edge of the nozzle cap to provide a lifting tab such that, if peeled away during shelf storage before purchase, evidences tampering. To facilitate easy removal by the purchaser, extension 46 may be removable by the provision of connecting ties 47 providing a line of weakening.

As shown in FIG. 5, rear wall 48 of cover strip 44 lies parallel to rear edges 49 of walls 43 spaced inwardly from outer edge 38 of support flange 27. Alternatively, outer side wall 43 of trigger sprayer 51 of FIGS. 7 and 8 can be designed as having its rear edges 49 merge with outer edge 38 of the hand support such that the rear portions of the outer side walls 43 extend rearwardly as shown to provide an alternative overall side profile compared to that of the FIGS. 4, 5 trigger sprayer.

Ribs 45 are integrally molded together with the pump body and outer side walls to provide support for cover 52 which, as in FIG. 5, can be a strip of adhesive backed plastic material or the like. The cover spans outer side walls 43 for completely covering the top and rear opening of the trigger which develops after the molding operation, and, the forward end of the strip can be extended as shown in FIG. 6 to provide tamper evident and shipping seal features.

Figure 9:
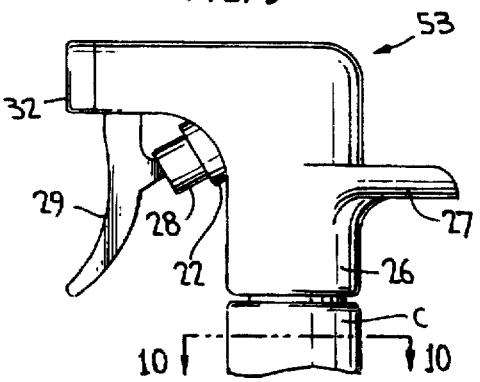
FIG. 9 is a side elevational view of another trigger sprayer according to the invention.
Figure 11:
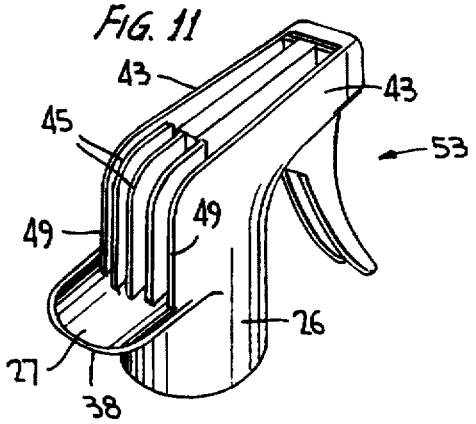
FIG. 11 is a perspective view of the FIG. 9 trigger sprayer showing the cover removed.
Figure 12:
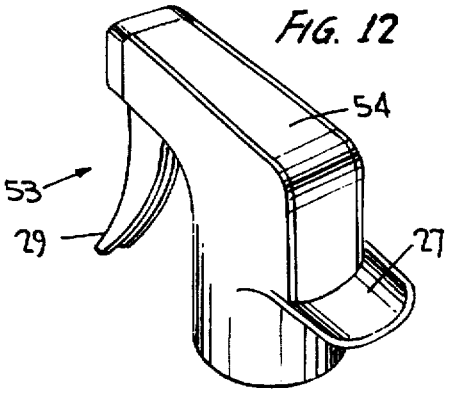
FIG. 12 is a perspective view of the FIG. 9 trigger sprayer showing the cover attached in place.

Trigger sprayer 53 of FIGS. 9, 11, 12 is similarly structured as described for trigger sprayers 42 and 51 except that trigger sprayer 53 has an alternative side profile. Integral closure cap 26 forms a smooth tubular extension from outer side walls 43, and rear edges 49 of the side walls are inwardly spaced from outer edge 38 of the hand support, much like that of FIG. 5 except that rear edges 49 are substantially upright. Ribs 45 are integrally molded with the side walls and the pump body and the hand support and closure, as in FIG. 7, and are shaped to match the shape of the outer side walls 43 to provide supports for cover 54, shown secured in place in FIG. 12. Again, the forward end of the cover can be extended to provide the tamper evident and shipping seal features described with reference to FIG. 6.

Figure 10:
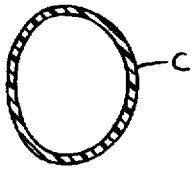
FIG. 10 is a cross-sectional view taken substantially along the line 10—10 of FIG. 9.

Container closure 26 may be substantially D-shaped for snap fitting to a correspondingly shaped neck of container C shown in FIG. 10. Thus, the trigger sprayer 53 can be oriented in only one position on the container.

Figure 13:
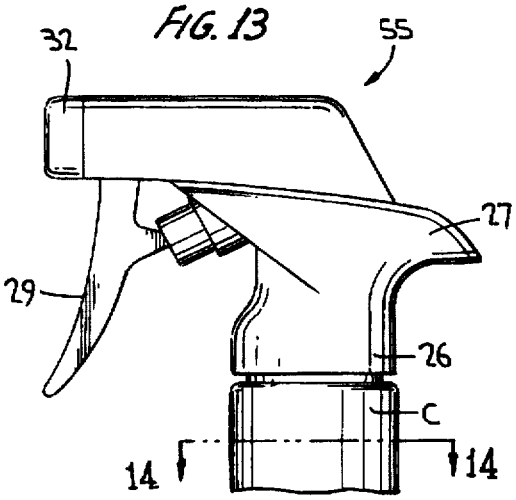
FIG. 13 is a side elevational view of another trigger sprayer according to the invention.
Figure 15:
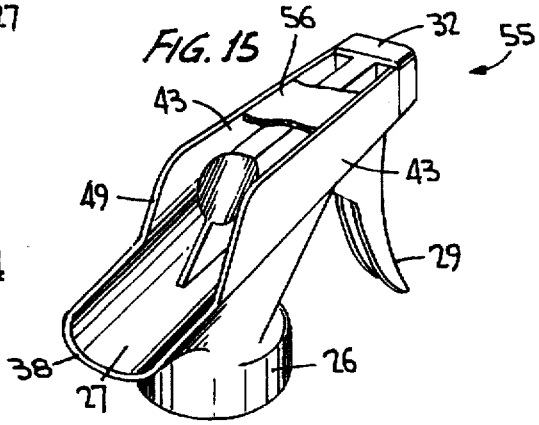
FIG. 15 is a perspective view of the FIG. 13 trigger sprayer with the attached cover shown broken away.

Trigger sprayer 55 of FIGS. 13 and 15 is of the same construction as described with reference to FIGS. 4 and 7, except that it has an alternative side profile. Rear edges 49 are likewise spaced inwardly from outer edge 38 of the hand support as in FIG. 11, except that the rear edges are sloped as shown. Cover 56, which may be an adhesive backed plastic strip, spans outer side walls 43 and is secured to confronting portions of the pump body. The forward end of the strip can be extended as in FIG. 6 to provide tamper evident and shipping seal features.

Figure 14:
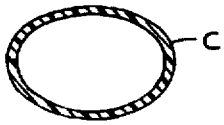
FIG. 14 is a cross-sectional view taken substantially along the line 14—14 of FIG. 13.

The integral closure cap 26 may be oval shaped for snap fitting to a similarly oval shaped neck of container C as shown in FIG. 14. This orients trigger sprayer 55 to the container in either of two positions.

The low cost trigger sprayer construction according to the invention permits the trigger sprayer to be disposed of after the contents of the connected container is emptied. The hand support and closure cap of each of the versions aforedescribed are integrally molded with the pump body, which eliminates the need for a separate part and likewise allows for a cover or shroud of inexpensive and less durable material and attachment means.

Obviously, many other modifications and variations of the present invention are made possible in the light of the above teachings. It is therefore to be understood that within the scope of the appended claims, the invention may be practiced otherwise than as specifically described.

What is claimed is:

1. A manually actuated pump sprayer comprising, a pump body, a hand support flange extending laterally from said pump body located for engaging an operator's hand when operating the sprayer, a container closure cap on said body, said pump body comprising a pump cylinder, an upstanding dip tube support sleeve, and a laterally extending tubular outlet, a reciprocable pump piston in said pump cylinder defining together therewith a variable volume pump chamber, and a trigger actuator hinged to said pump body for manually actuating said piston, said pump cylinder, said support sleeve, said tubular outlet, said closure cap and said hand support flange being of a one-piece molded plastic construction, said pump body having at least a top end and a rearward end adjacent said flange, and a separate cover overlying said top end and said rearward end, said cover extending to said flange and being attached to said pump body.

2. The pump sprayer according to claim 1, wherein said pump body further has opposed sides, said cover comprising a shroud having top, rear and opposing side walls enclosing said top end, rearward end and opposed sides of said pump body.

3. The pump sprayer according to claim 1, wherein said pump body further has open opposed sides, said cover comprising a shroud having top, rear and opposing side walls overlying said flange and enclosing said top end, rearward end and opposed sides of said pump body.

4. The pump sprayer according to claim 2, wherein said shroud is of a one-piece molded plastic construction.

5. The pump sprayer according to claim 3, wherein said shroud is of a one-piece molded plastic construction.

6. The pump sprayer according to claim 1, further comprising opposing outer side walls of molded plastic construction with said flange, said closure and said pump body, said outer side walls being located at opposing sides of said pump body, said cover spanning said side walls and having a rearward wall spaced inwardly of a rearward edge of said flange.

7. The pump sprayer according to claim 1, further comprising opposing outer side walls of molded plastic construction integral with said flange, said closure and said pump body, said outer side walls being located at opposing sides of said pump body, said cover spanning said side walls and having a rearward wall extending to a rearward edge of said flange.

8. The pump sprayer according to claim 6, wherein said cover comprises a strip of adhesive backed tape.

9. The pump sprayer according to claim 7, wherein said cover comprises a strip of adhesive backed tape.

10. The pump sprayer according to claim 8, further comprising a rotatable nozzle cap having a discharge orifice, said cap being mounted at an outer end of said tubular outlet, said tape forming a tab removably secured to said nozzle cap to provide a tamper evident feature.

11. The pump sprayer according to claim 10, wherein said tape tab covers said orifice to further provide a shipper seal.

12. The pump sprayer according to claim 9, further comprising a rotatable nozzle cap having a discharge orifice, said cap being mounted at an outer end of said tubular outlet, said tape forming a tab removable secured to said nozzle cap to provide a tamper evident feature.

13. The pump sprayer according to claim 12, wherein said tape tab covers said orifice to further provide a shipper seal.

14. The pump sprayer according to claim 1, wherein said container closure cap is out-of-round in shape for engagement with the neck of a container of out-of-round finish for orienting the pump sprayer relative to the container.

15. The pump sprayer according to claim 14, wherein said shape of said closure cap is substantially D-shaped.

16. The pump sprayer according to claim 14, wherein said shape of said closure cap is oval.

* * * * *